US007639959B2

(12) United States Patent
Hirayama

(10) Patent No.: US 7,639,959 B2
(45) Date of Patent: Dec. 29, 2009

(54) IMAGE FORMING APPARATUS INCLUDING MOVABLE BELT UNIT AND MOVABLE DETECTING MEMBER

(75) Inventor: Taiya Hirayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 420 days.

(21) Appl. No.: 11/530,780

(22) Filed: Sep. 11, 2006

(65) Prior Publication Data

US 2007/0140733 A1 Jun. 21, 2007

(30) Foreign Application Priority Data

Dec. 16, 2005 (JP) ..... 2005-363443

(51) Int. Cl.
*G03G 15/00* (2006.01)
*G03G 15/16* (2006.01)

(52) U.S. Cl. ..... 399/49; 399/74; 399/110; 399/121

(58) Field of Classification Search ..... 399/49, 399/110, 121, 298, 299, 302, 303, 74
See application file for complete search history.

(56) References Cited

U.S. PATENT DOCUMENTS 6,343,198 B1 * 1/2002 Sato ..... 399/121
7,218,868 B2 * 5/2007 Ahn et al. ..... 399/121
7,302,208 B2 * 11/2007 Tsuda et al. ..... 399/121

FOREIGN PATENT DOCUMENTS

| | | |
|---|---|---|
| JP | 2000-187400 | 7/2000 |
| JP | 2003-195578 | 7/2003 |
| JP | 2004-029213 | 1/2004 |
| JP | 2004-053819 | 2/2004 |
| JP | 2004-144878 | 5/2004 |

* cited by examiner

*Primary Examiner*—William J Royer
(74) *Attorney, Agent, or Firm*—Canon USA Inc IP Div

(57) ABSTRACT

An image forming apparatus includes a toner image forming device, a toner image conveyer unit, a control device, and a moving device. The toner image conveyer unit includes a toner image conveyer, a supporting member that detachably supports the toner image conveyer, and a detecting member that detects a toner image on the toner image conveyer. The toner image conveyer unit is movable between a first position where the toner image is formed on the toner image conveyer and a second position where the toner image conveyer is attached to or detached from the supporting member. The moving device moves the detecting member located at a position to detect the toner image, away from the toner image conveyer supported by the supporting member, in conjunction with an operation to move the toner image conveyer unit from the first position to the second position.

20 Claims, 6 Drawing Sheets

IMAGE FORMING APPARATUS INCLUDING MOVABLE BELT UNIT AND MOVABLE DETECTING MEMBER

BACKGROUND OF THE INVENTION

1. Field of the Invention

The present invention relates to an image forming apparatus including a toner image conveyer unit. The unit includes a toner image conveyer that conveys toner images and a supporting member that supports the toner image conveyer. The unit is movable from a position where toner images are formed to a position where the toner image conveyer is attached or detached.

More specifically, the present invention relates to an image forming apparatus further including a detecting member that detects a toner image formed on the toner image conveyer.

2. Description of the Related Art

Japanese Patent Laid-Open No. 2003-195578 discloses an image forming apparatus including a toner image conveyer unit. The unit includes a toner image conveyer and a supporting member that supports the toner image conveyer. The unit is movable from a position where toner images are formed to a position where the toner image conveyer is attached or detached. Unitizing the toner image conveyer and the supporting member and making the unit movable from a position where toner images are formed to a position where the toner image conveyer is attached or detached facilitates the replacement of the toner image conveyer.

In addition, the apparatus body of the image forming apparatus disclosed in Japanese Patent Laid-Open No. 2003-195578 is provided with a detecting member that detects a toner image on the toner image conveyer.

However, in an image forming apparatus whose toner image conveyer unit is movable, if a detecting member that detects a toner image on the toner image conveyer is provided in the apparatus body, the positional accuracy of the detecting member with respect to the toner image conveyer deteriorates. Therefore, the detecting member is provided in the toner image conveyer unit.

However, if the detecting member is provided in the toner image conveyer unit, the detecting member can interfere with the attachment and detachment of the toner image conveyer to and from the toner image conveyer unit.

SUMMARY OF THE INVENTION

The present invention is directed to an image forming apparatus that includes a toner image conveyer unit that is movable relative to the apparatus body and that prevents a detecting member from interfering with attachment and detachment of a toner image conveyer to and from the toner image conveyer unit.

In an aspect of the present invention, an image forming apparatus includes a toner image forming device, a toner image conveyer unit, a control device, and a moving device. The toner image forming device is configured to form a toner image. The toner image conveyer unit includes a toner image conveyer configured to convey the toner image, a supporting member that detachably supports the toner image conveyer, and a detecting member configured to detect the toner image on the toner image conveyer. The toner image conveyer unit is movable between a first position where the toner image is formed on the toner image conveyer and a second position where the toner image conveyer is attached to or detached from the supporting member. The control device controls conditions of toner image formation of the toner image forming device on the basis of detection results of the detecting member. The moving device moves the detecting member located at a position to detect the toner image, away from the toner image conveyer supported by the supporting member, in conjunction with an operation to move the toner image conveyer unit from the first position to the second position.

Further features of the present invention will become apparent from the following description of exemplary embodiments (with reference to the attached drawings).

DESCRIPTION OF THE EMBODIMENTS

An embodiment of the present invention will now be described with reference to the drawings.

Figure 1:
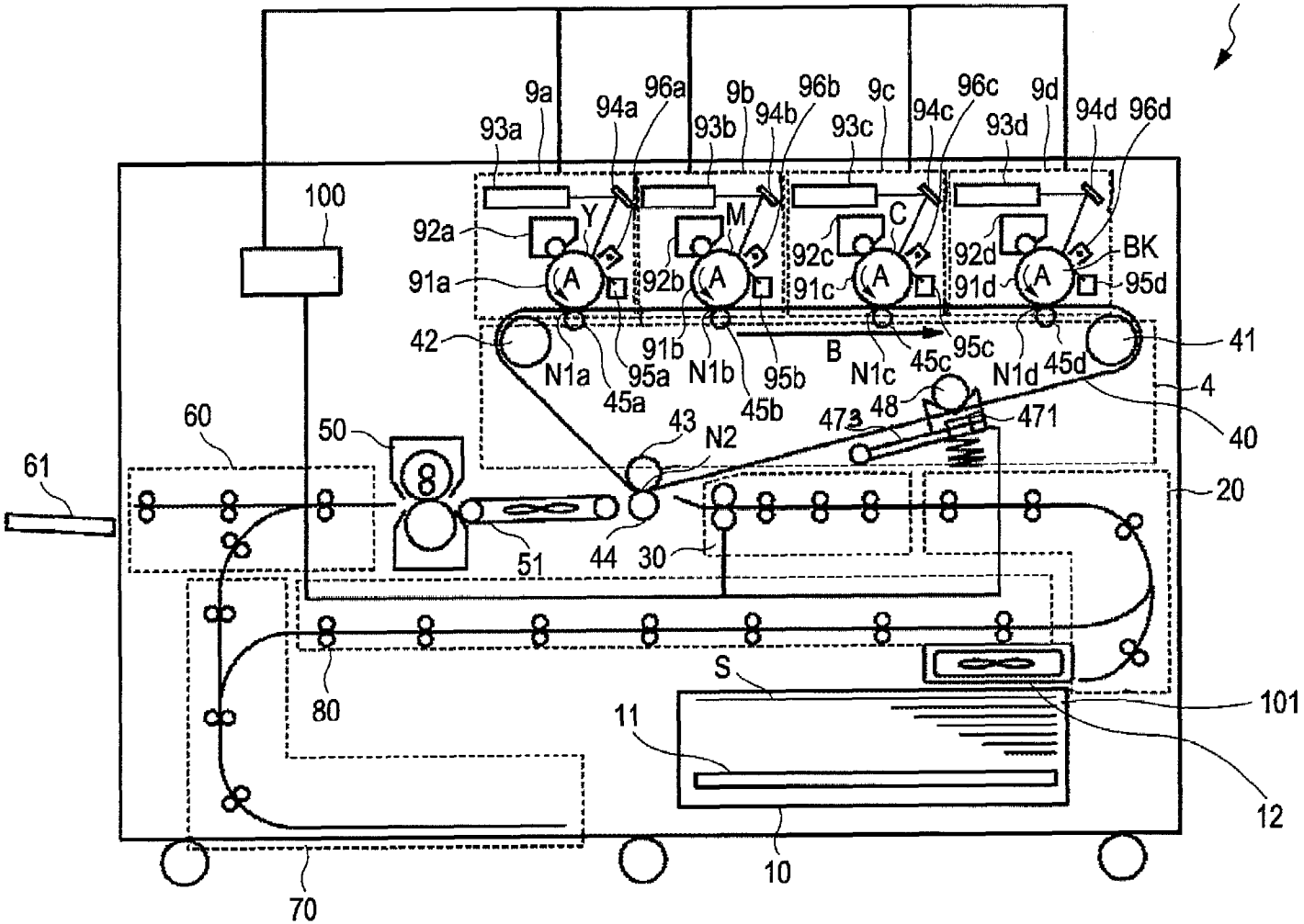
FIG. 1 is a sectional view of an image forming apparatus.

FIG. 1 is a sectional view of an image forming apparatus 1.

The image forming apparatus 1 of this embodiment includes a plurality of image forming sections 9*a* to 9*d*, which form electrostatic latent images on photosensitive drums (image carriers) 91 (91*a*, 91*b*, 91*c*, and 91*d*) each rotating in the direction of arrow A and then form visible images (toner images) from the electrostatic latent images.

The image forming apparatus 1 further includes an intermediate transfer belt (intermediate transfer member) 40 serving as a toner image conveyer, onto which visible images are sequentially transferred from the image forming sections 9*a* to 9*d*. The image forming apparatus 1 further includes a second transfer device 44 and a fixing unit 50. The second transfer device 44 transfers color images on the intermediate transfer belt 40 onto a transfer medium S. The fixing unit 50 fixes the transferred color images to the transfer medium S.

The image forming sections (toner image forming devices) 9*a* to 9*d* have the same structure and form yellow, magenta, cyan, and black images, respectively. Each photosensitive drum 91 is rotatably supported at its center and driven by a driving device (not shown).

The photosensitive drum (photosensitive member) 91 has a photosensitive layer. First, a corona charger (charging device) 96 (96*a*-96*d*) uniformly charges the surface of the photosensitive drum 91. Next, a laser scanner unit (exposing device) 93 (93*a*-93*d*) scans and exposes the surface with and to a laser beam modulated according to an image signal. Thus, an electrostatic latent image is formed. A mirror 94 (94*a*-94*d*) changes the light path of the laser beam.

Developing units (developing devices) 92 (92*a*, 92*b*, 92*c*, and 92*d*) respectively contain yellow, magenta, cyan, and black developers (hereinafter referred to as "toners"). Each developing unit 92 changes the electrostatic latent image into a visible image (toner image).

The intermediate transfer belt 40 rotates in the direction of arrow B. A first transfer roller (first transfer device) 45 (45*a*-45*d*) is disposed so as to face the intermediate transfer belt 40. A bias is applied to the first transfer roller 45. The toner image on the photosensitive drum 91 is thereby transferred to the intermediate transfer belt 40 at a first transfer section (first transfer position) N1 (N1*a*-N1*d*).

A photosensitive drum cleaner 95 (95*a*-95*d*) is disposed on the downstream side of the first transfer position N1 of the photosensitive drum 91. The photosensitive drum cleaner 95 cleans the surface of the photosensitive drum 91 by scraping off the toner with a cleaning blade. Through the above-described process, the toner images are sequentially transferred onto the intermediate transfer belt 40. Thus, layers of toner images are formed on the intermediate transfer belt 40.

The layers of toner images on the intermediate transfer belt 40 are conveyed by the rotation of the intermediate transfer belt 40 to a second transfer section (second transfer position) N2 where the layers of toner images are transferred onto the transfer medium S. At the second transfer section N2, a bias is applied to the second transfer roller (second transfer device) 44 from a power source (not shown). The layers of toner images on the intermediate transfer belt 40 are thereby transferred onto the transfer medium S.

Transfer media S are contained in a paper feeding unit 10. A lifter plate 11 holds the transfer media S at a predetermined paper feeding section (paper feeding position) 101. A paper feeding and separating unit 12 feeds the transfer media S one by one. The transfer medium S is conveyed by a conveyer unit 20. A register unit 30 performs register adjustment. Next, in synchronization with the layers of toner images on the intermediate transfer belt 40, the transfer medium S is conveyed to the second transfer section (second transfer position) N2.

At the second transfer section N2, a bias is applied to the second transfer roller (second transfer device) 44. The layers of toner images on the intermediate transfer belt 40 are thereby transferred onto the transfer medium S. The transfer medium S is then conveyed to the fixing unit 50 by a pre-fixation conveyer unit 51. The layers of toner images are fixed to the transfer medium S. Thus, a full color image is obtained.

In the case where a monochrome image is formed on a transfer medium S, a monochrome toner image is transferred from a certain image forming section 9 to the intermediate transfer belt 40. The subsequent process is the same as in the full color image formation.

In an one-side printing process in which printing is performed on only one side of a transfer medium S, the transfer medium S is conveyed by a paper discharge unit 60 and discharged onto a discharged paper tray 61.

In a two-side printing process in which printing is performed on both sides of a transfer medium S, the transfer medium S is conveyed to a reversing unit 70. The reversing unit 70 reverses the transfer medium S. The reversed transfer medium S is again conveyed to the conveyer unit 20 and the register unit 30 via a two-side conveyer unit 80. After another toner image is transferred and fixed to the reverse side, the transfer medium S is discharged onto the discharged paper tray 61.

Figure 3A:
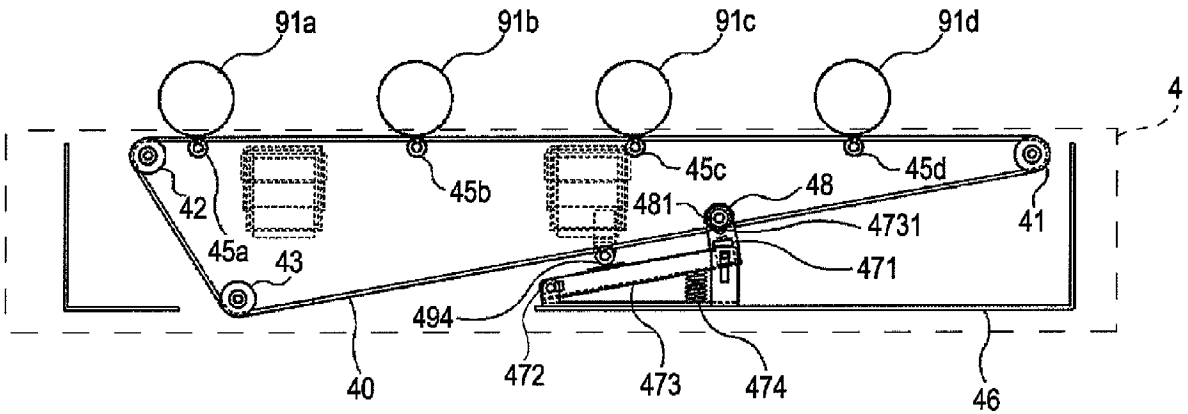
FIGS. 3A and 3B are sectional views showing the operation of an intermediate transfer belt of the image forming apparatus.
Figure 3B:
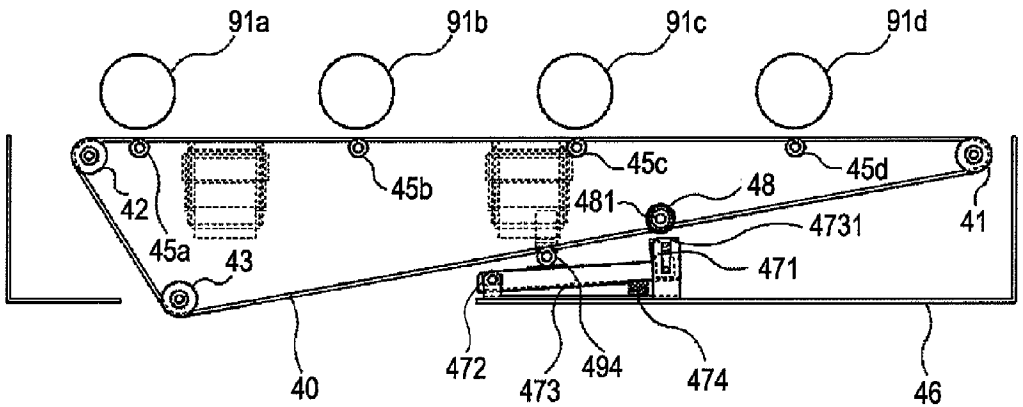

Next, an intermediate transfer unit (toner image conveyer unit) 4 of the image forming apparatus 1 will be described in detail. As shown in FIGS. 3A and 3B, the intermediate transfer unit 4 is an integration of the intermediate transfer belt 40, belt supporting members (a tension roller 41, a driving roller 42, a second transfer inner roller 43, and an idler roller 48), an optical sensor 471, and an intermediate transfer member supporting frame 46. In addition, as shown in FIGS. 4B and 5A, the intermediate transfer belt 40 and the belt supporting members 41, 42, 43 and 48 constitute a belt unit 140.

The intermediate transfer belt 40 can be an endless belt whose thickness is at least 50 μm and no more than 200 μm. The intermediate transfer belt 40 can be formed of a resin material such as polyimide, PET, or PVD. The intermediate transfer belt 40 is stretched around the tension roller 41, the driving roller 42, the second transfer inner roller 43, and the idler roller (positioning member) 48. At this time, a tensile force of about 8 kgf is exerted on the tension roller 41. The tensile force is not limited to this value and is at least 6 kgf and no more than 10 kgf.

The driving roller 42 is driven and rotated by a driving device (not shown). The intermediate transfer belt 40 is driven in the direction of arrow B in FIG. 1. The tension roller 41 has a function of controlling the displacement of the intermediate transfer belt 40 in the width direction. Specifically, one end in the longitudinal direction of the tension roller 41 is displaced by a belt displacement control device (not shown), and the intermediate transfer belt 40 is thereby moved in the width direction. As a result, the position in the width direction of the intermediate transfer belt 40 is maintained within a predetermined range. Therefore, damage to the intermediate transfer belt 40 due to overdisplacement can be prevented.

Next, the supporting structure of the belt unit 140 will be described with reference to FIGS. 1, 2A, 2B, 3A, 3B, 4A, 4B, 5A, 5B, and 6. In FIGS. 4A, 4B, 5A, and 5B, the belt unit 140 is joined to the intermediate transfer member supporting frame 46 serving as a supporting member via a hinge unit 49 and is housed in the image forming apparatus 1. The hinge unit 49 includes a vertical movement guide 491, a vertically moving member 492, and a rotating member 493. The vertical movement guide 491 is attached to the intermediate transfer member supporting frame 46. The vertically moving member 492 is movably supported by the vertical movement guide 491 in the vertical direction. The rotating member 493 is rotatably attached to the vertically moving member 492 around a rotating shaft 4931. The belt unit 140 is attached to the rotating member 493. The intermediate transfer member supporting frame 46 is attached to the image forming apparatus 1 via slide rails (pulling out devices) 461 shown in FIG. 6. Due to the above-described structure, the intermediate transfer unit 4 can be fixed at the following two positions: (1) image forming position(first position): a position where the intermediate transfer unit 4 is housed in the body of the image forming apparatus 1, and the intermediate transfer belt 40 is in contact with the photosensitive members 91 (FIGS. 3A and 4A) or out of contact with the photosensitive members 91 (FIGS. 3B and 4B); and (2) maintenance position (second position): a position where the intermediate transfer unit 4 is pulled out of the body of the image forming apparatus 1 in the direction of arrow X in FIG. 4B, and the belt unit 140 is rotated around the pivot of the hinge unit 49 and fixed in an upward inclining state (FIGS. 5A and 6).

Figure 7A:
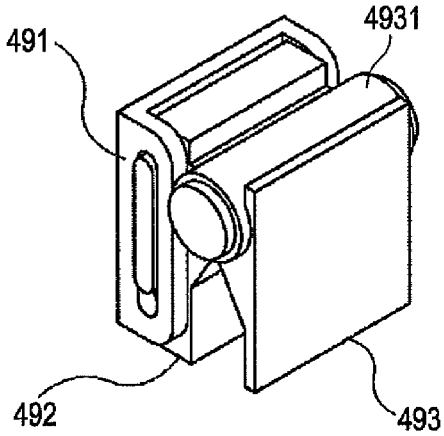
FIGS. 7A and 7B are perspective views of a hinge unit used in the image forming apparatus.
Figure 7B:
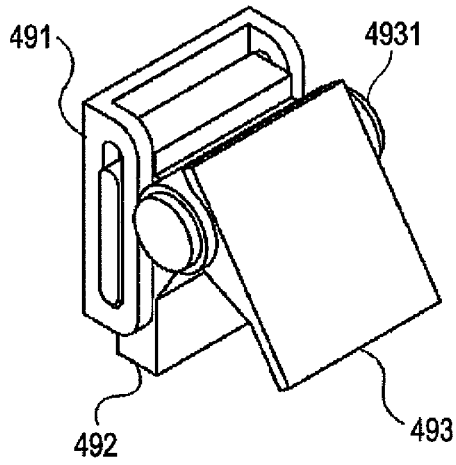

FIGS. 7A and 7B show the hinge unit 49. FIG. 7A shows the hinge unit 49 when the belt unit 140 is at the image forming position. FIG. 7B shows the hinge unit 49 when the belt unit 140 is at the maintenance position.

At the maintenance position, by loosening the tension of the intermediate transfer belt 40, the intermediate transfer belt 40 can be replaced without detaching the belt supporting members 41, 42, 43, and 48 from the body of the image forming apparatus 1.

Next, the installation structure of the optical sensor 471 will be described with reference to FIGS. 2A, 2B, 3A, and 3B.

The optical sensor (detecting member) 471 reads the toner image (toner patch) formed on the intermediate transfer belt 40.

The optical sensor 471 detects the passage timing of the toner image. On the basis of the detection result, a CPU (control device) 100 controls the conveyance timing of a transfer medium S to be supplied to the second transfer position N2 and the timing when electrostatic latent images are formed on the photosensitive drums 91*a* to 91*d*. Thus, the image transfer position on the transfer medium S is positioned with a high degree of accuracy.

The optical sensor 471 is integrated with a sensor support 473 and attached to the intermediate transfer member supporting frame 46. One end of the sensor support 473 is supported by a rotating shaft 472. The optical sensor 471 is attached to the other end of the sensor support 473 so as to face the intermediate transfer belt 40. That is to say, the optical sensor 471, the rotating shaft 472, and the sensor support 473 constitute an optical sensor unit and can move together.

The sensor support 473 has engaging parts 4731. When the intermediate transfer belt 40 is in contact with the photosensitive member 91, the sensor support 473 is pressed against the belt unit 140 by pressing springs 474. The engaging parts 4731 engage with bearing members 481 attached at both ends of the idler roller 48.

Thus, the distance between the optical sensor 471 and the intermediate transfer belt 40, and the position of the optical sensor 471 in the direction in which the intermediate transfer belt 40 moves are accurately positioned. Therefore, highly accurate reading of the toner patch is ensured.

Figure 2A:
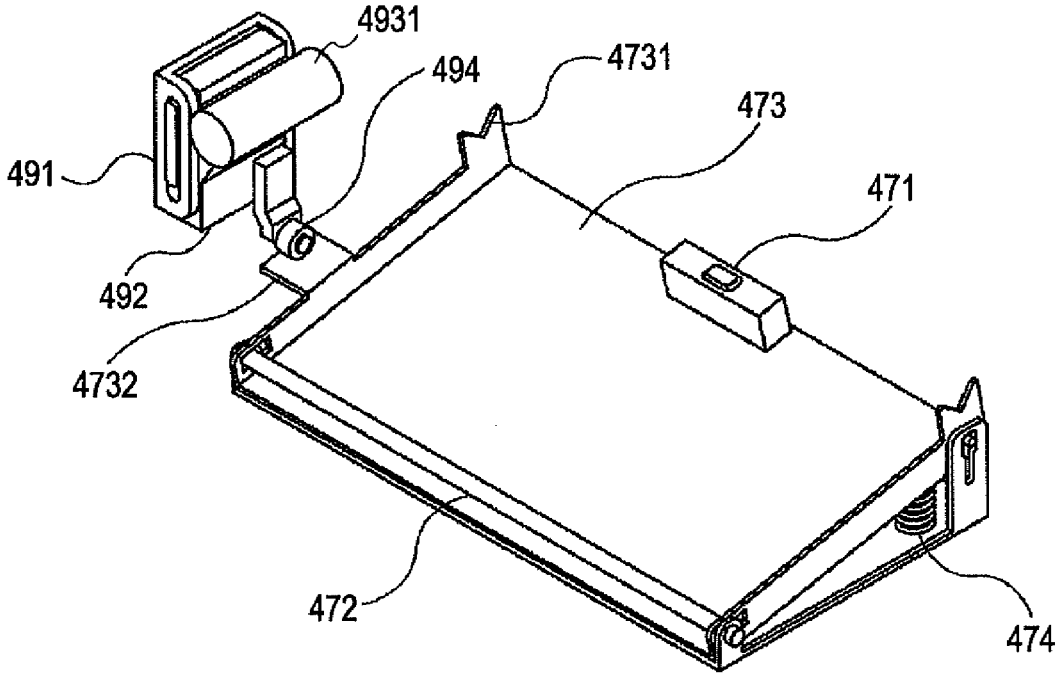
FIGS. 2A and 2B are perspective views showing the installation structure of an optical sensor unit of the image forming apparatus.
Figure 2B:
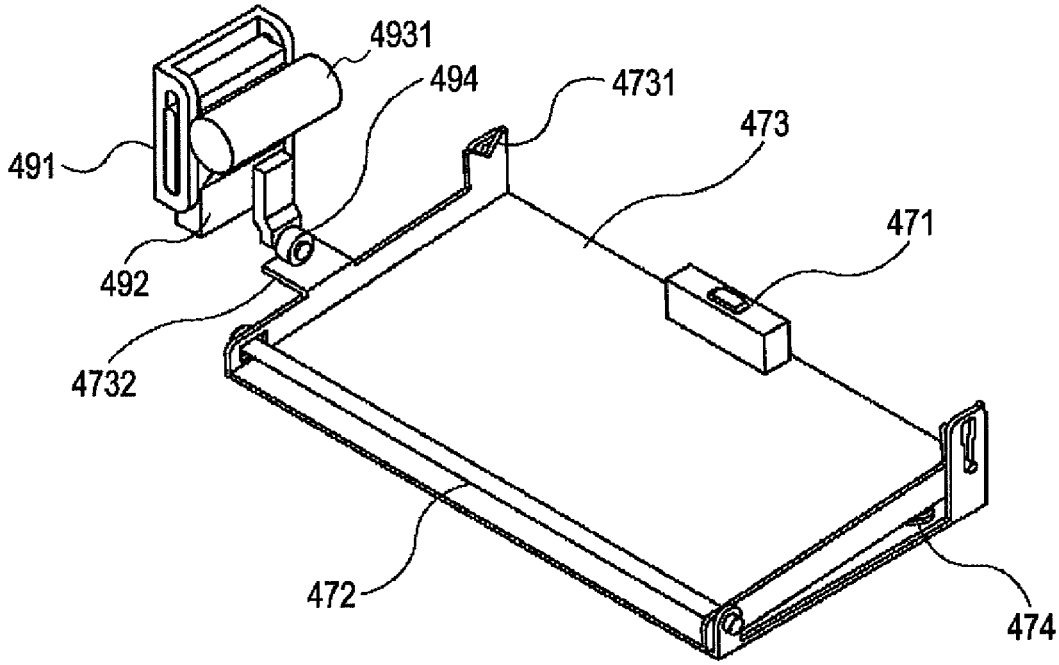

Next, a moving mechanism serving as a moving device that takes the optical sensor 471 out of contact with the intermediate transfer belt 40 in conjunction with the operation to move the intermediate transfer unit 4 from the image forming position to the maintenance position, will be described. A depressing member 494 is attached to the vertically moving member 492 of the hinge unit 49. As shown in FIGS. 2A and 3A, when the intermediate transfer belt 40 is in contact with the photosensitive member 91, the distance between the intermediate transfer belt 40 and the optical sensor 471 is maintained at 6 mm. As shown in FIGS. 2B and 3B, when the belt unit 140 is lowered to take the intermediate transfer belt 40 out of contact with the photosensitive member 91, the depressing member 494 comes into contact with a contact part 4732 of the sensor support 473 and presses down the sensor support 473. When the sensor support 473 has been pressed down, the distance between the intermediate transfer belt 40 and the optical sensor 471 is 15 mm. This distance is not limited to 15 mm and is at least 14 mm and no more than 30 mm.

That is to say, in order to move the intermediate transfer unit 4 from the image forming position to the maintenance position, the belt unit 140 is lowered and the intermediate transfer belt 40 is taken out of contact with the photosensitive member 91. In conjunction with this separating operation, the optical sensor 471 is also lowered. At this time, since one end of the sensor support 473 is supported by the sensor rotating shaft 472, the sensor support 473 rotates downward around the sensor rotating shaft 472. That is to say, in conjunction with the movement of the intermediate transfer unit 4 from the image forming position to the maintenance position, the optical sensor 471 moves away from the intermediate transfer belt 40. Due to this movement, the distance between the intermediate transfer belt 40 and the optical sensor 471 when the intermediate transfer unit 4 is at the maintenance position is larger than that when the intermediate transfer unit 4 is at the image forming position.

Since the contact part 4732 is disposed between the sensor rotating shaft 472 and the optical sensor 471 mounting part, the downward moving distance of the optical sensor 471 mounting part is larger than that of the contact part 4732.

Thus, as shown in FIG. 3B, when the intermediate transfer belt 40 is out of contact with the photosensitive member 91, the engaging parts 4731 of the sensor support 473 is also out of contact with the bearing members of the idler roller 48.

In addition, when the belt unit 140 is fixed in the upward inclining state (FIGS. 5A and 6), since the vertically moving member 492 is at the lower position, the sensor support 473 remains depressed by the depressing member 494.

Figure 5A:
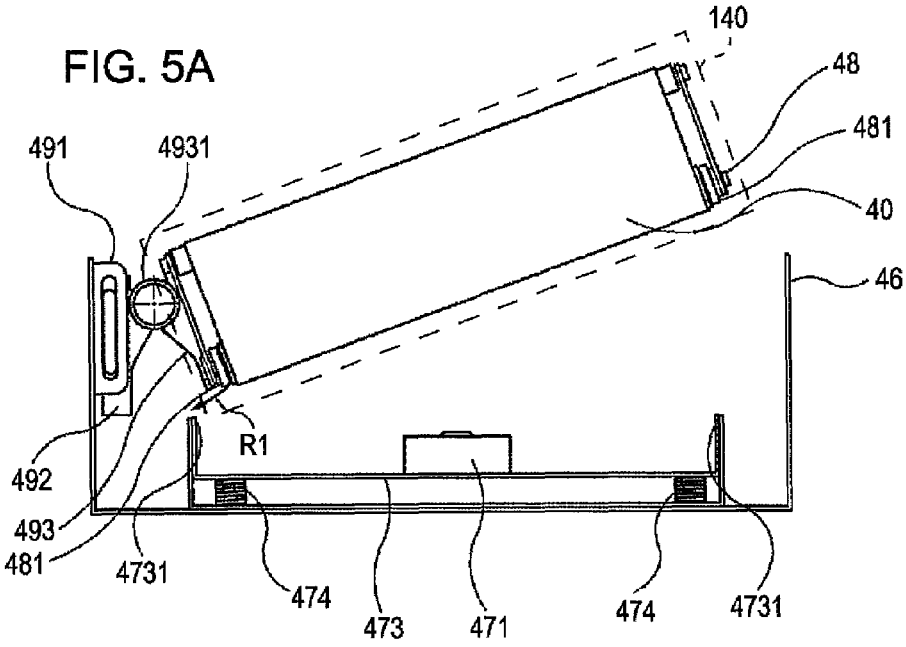
FIGS. 5A and 5B are schematic views showing the effect of the releasing operation of the optical sensor unit of the image forming apparatus.
Figure 5B:
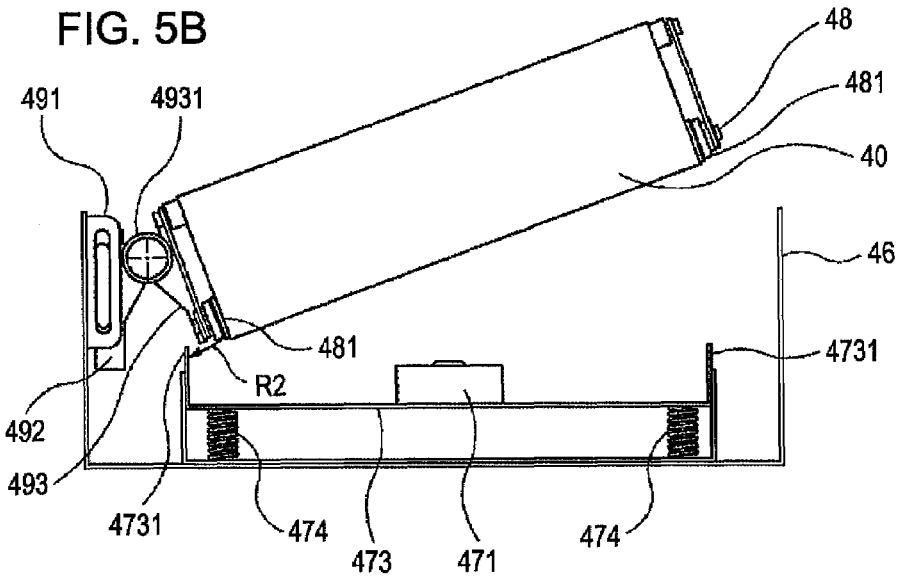
Figure 6:
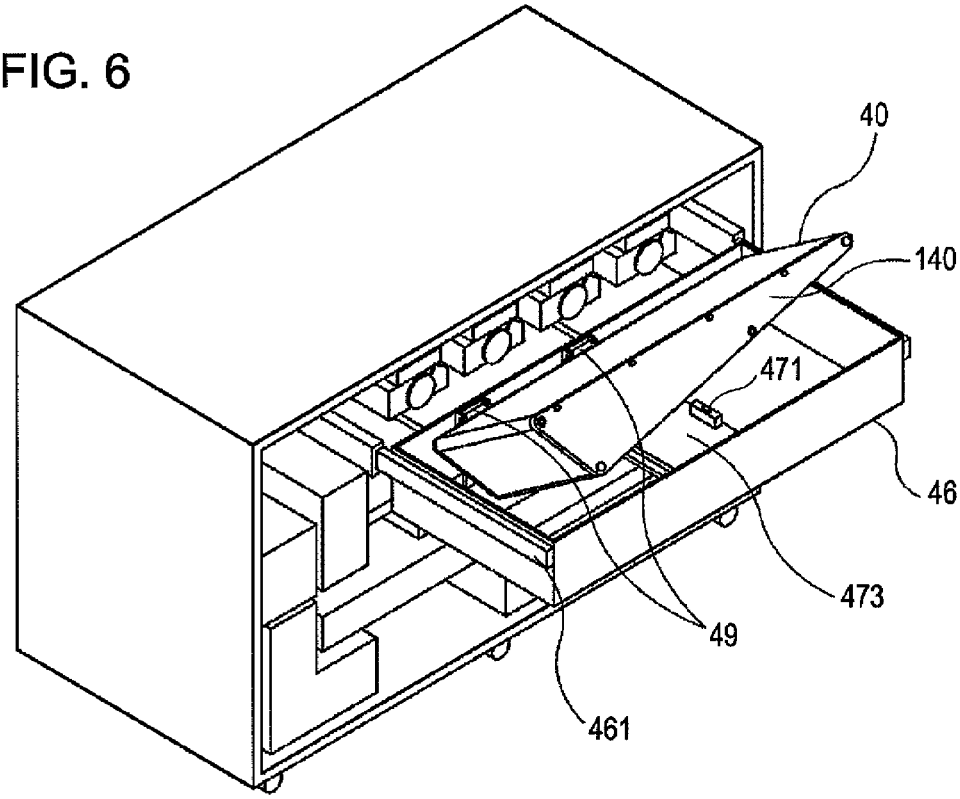
FIG. 6 is a perspective view showing an intermediate transfer member of the image forming apparatus under maintenance.

When the intermediate transfer unit 4 is fixed in the upward inclining state shown in FIG. 5B, the distance between the intermediate transfer belt 40 and the optical sensor 471 is 300 mm. This distance is not limited to 300 mm and is at least 150 mm and no more than 500 mm.

Figure 4A:
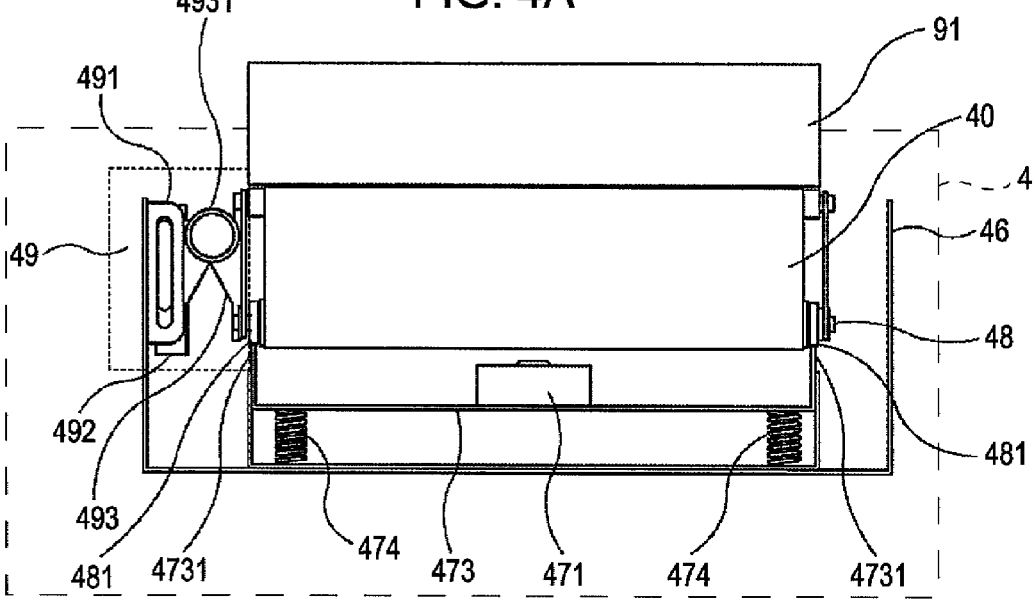
FIGS. 4A and 4B are schematic views showing the releasing operation of the optical sensor unit of the image forming apparatus.
Figure 4B:
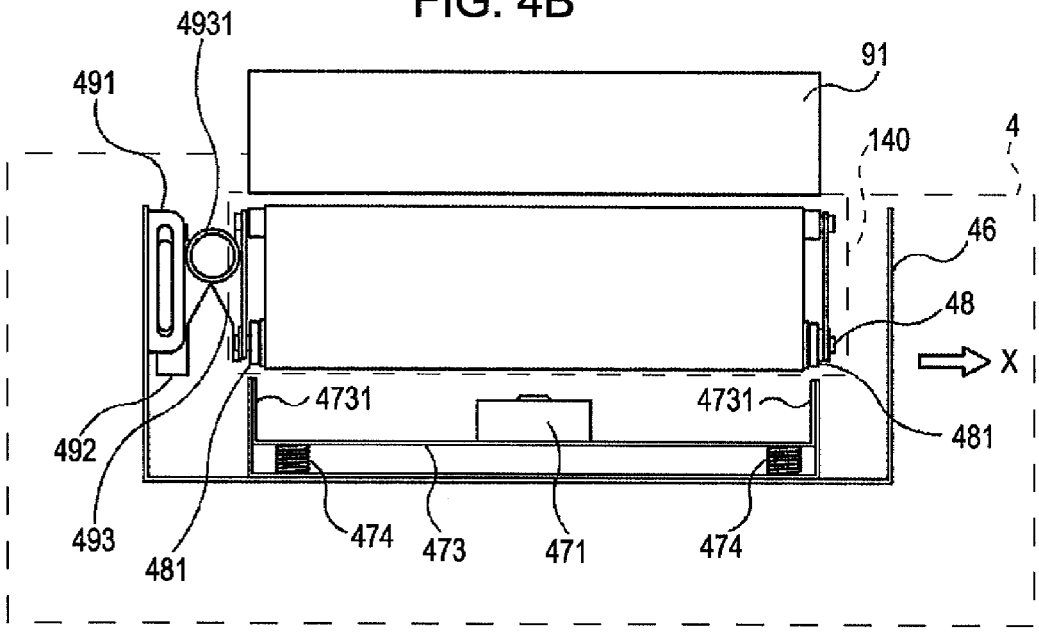

FIGS. 4A and 4B schematically show the optical sensor unit in the released state and the depressed state as viewed from the side of the apparatus body through the apparatus body. FIG. 4A shows the state in which the intermediate transfer belt 40 is in contact with the photosensitive member 91. FIG. 4B shows the state in which the intermediate transfer belt 40 is out of contact with the photosensitive member 91.

When the intermediate transfer unit 4 is at the image forming position, the engaging parts 4731 of the sensor support 473 are in contact with the bearing members 481 attached to both ends of the idler roller 48. The optical sensor 471 is positioned so that the distance to the intermediate transfer belt 40 is 6 mm. The distance between the intermediate transfer belt 40 and the optical sensor 471 may have any value from 2 mm to 12 mm.

When the belt unit 140 is lowered and the intermediate transfer belt 40 is taken out of contact with the photosensitive drum 91, the downward moving distance of the optical sensor 471 is larger than that of the belt unit 140, and the bearing members 481 are taken out of contact with the engaging parts 4731.

FIG. 5A schematically shows the state in which the intermediate transfer unit 4 is at the maintenance position and the belt unit 140 has been rotated so as to incline upwardly.

The arrow R1 in the figure shows the locus that the lower end of the left-hand bearing member 481 describes when the belt unit 140 is rotated downward from the upwardly inclining state.

At the maintenance position, the optical sensor 471 is held depressed by the depressing member 494.

Therefore, when the belt unit 140 is rotated downward, the left-hand bearing member 481 does not come into contact with the left-hand engaging part 4731, and smooth rotating operation of the belt unit 140 is ensured.

FIG. 5B is a schematic view showing a comparative example. In this example, when the belt unit 140 is held in the upward inclining state, the optical sensor 471 is not depressed by the depressing member 494 against the pressing springs 474. As in FIG. 5A, the arrow R2 in the figure shows the locus that the lower end of the left-hand bearing member 481 describes when the belt unit 140 is rotated downward from the upwardly inclining state. In this case, the left-hand bearing member 481 comes into contact with the left-hand engaging part 4731. Therefore, smooth rotating operation is not ensured. In addition, the belt unit 140 can be damaged.

In this embodiment, since the above-described moving mechanism is provided, when the belt unit 140 is attached to or detached from the intermediate transfer member supporting frame 46, the optical sensor 471 is out of contact with the intermediate transfer belt 40. Therefore, the optical sensor 471 does not interfere, and the belt unit 140 can be smoothly attached to or detached from the intermediate transfer member supporting frame 46. As described above, in conjunction with the moving operation of the intermediate transfer unit 4 from the image forming position to the maintenance position, the optical sensor 471 is taken out of contact with the intermediate transfer belt 40. Therefore, the intermediate transfer belt 40 can be smoothly attached to or detached from the supporting member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-363443 filed Dec. 16, 2005, which is hereby incorporated by reference herein in its entirety.

What is claimed is:

1. An image forming apparatus comprising:

an image bearing member:

a toner image forming device configured to form a toner image on the image bearing member;

a belt unit including:

a belt member configured to bear the toner image transferred from the image bearing member; and a supporting member that supports the belt member, wherein the belt unit is movable between a first position where the belt member is in contact with the image bearing member and the toner image is formed on the belt member and a second position where the belt member is apart from the image bearing member;

a detecting member configured to detect the toner image on the belt member positioned at the first position;

a control device that controls conditions of toner image formation of the toner image forming device on the basis of detection results of the detecting member; and a moving device that moves the detecting member so that a distance between the detecting member and the belt member is greater at the second position than at the first position, in conjunction with an operation to move the belt unit from the first position to the second position.

2. The image forming apparatus according to claim 1, wherein when the detecting member is located at the position to detect, the detecting member is positioned by a positioning member that is in contact with the belt unit.

3. The image forming apparatus according to claim 1, wherein the toner image forming device includes a charging device that charges the image bearing member, an exposing device that exposes the charged image bearing member so as to form an electrostatic image, and a developing device that develops the electrostatic image.

4. The image forming apparatus according to claim 1, wherein the detecting member is located lower than the belt member in a vertical direction of the image forming apparatus.

5. The image forming apparatus according to claim 1, further comprising:

a first supporting member that supports the detecting member; and a second supporting member that supports the belt unit, wherein the second supporting member moves in conjunction with the first supporting member.

6. The image forming apparatus according to claim 5, wherein the belt unit is capable of being withdrawn from the image forming apparatus, and wherein the withdrawn belt unit is rotatably held by the first supporting member.

7. The image forming apparatus according to claim 5, wherein the first supporting member is positioned upstream in a direction of withdrawal.

8. The image forming apparatus according to claim 5, wherein the second supporting member moves in conjunction with the first supporting member.

9. The image forming apparatus according to claim 5, further comprising:

a container configured to contain the belt unit and the detecting member, the container capable of being withdrawn from the image forming apparatus, wherein the belt unit is rotatable in relation to the belt unit while the detecting member remains in the withdrawn container.

10. The image forming apparatus according to claim 1, wherein the moving device moves the detecting member so that a distance between the detecting member and the belt member is smaller at the first position than at the second position, in conjunction with an operation to move the belt unit from the second position to the first position.

11. An image forming apparatus comprising:

an image bearing member:

a toner image forming device configured to form a toner image on the image bearing member;

a belt unit including:

a belt member configured to bear the toner image transferred from the image bearing member; and a supporting member that supports the belt member, wherein the belt unit is movable between a first position where the belt member is in contact with the image bearing member and the toner image is formed on the belt member and a second position where the belt member is apart from the image bearing member;

a detecting member configured to detect the toner image on the belt member positioned at the first position;

a control device that controls conditions of toner image formation of the toner image forming device based on detection results of the detecting member; and a moving device that moves the detecting member so that a distance between the detecting member and the belt member is smaller at the first position than at the second position, in conjunction with an operation to move the belt unit from the second position to the first position.

12. The image forming apparatus according to claim 11, wherein when the detecting member is located at a position to detect, the detecting member is positioned by a positioning member that is in contact with the belt unit.

13. The image forming apparatus according to claim 11, wherein the toner image forming device includes a charging device that charges the image bearing member, an exposing device that exposes the charged image bearing member so as to form an electrostatic image, and a developing device that develops the electrostatic image.

14. The image forming apparatus according to claim 11, wherein the detecting member is positioned lower than the belt member in a vertical direction of the image forming apparatus.

15. The image forming apparatus according to claim 11, further comprising:

a first supporting member configured to support the detecting member; and a second supporting member configured to support the belt unit, wherein the second supporting member moves in conjunction with the first supporting member.

16. The image forming apparatus according to claim 15, wherein the belt unit is capable of being withdrawn from the image forming apparatus, and wherein the withdrawn belt unit is rotatably supported by the first supporting member.

17. The image forming apparatus according to claim 15, wherein the first supporting member is positioned upstream in a withdrawal direction.

18. The image forming apparatus according to claim 15, wherein the second supporting member moves in conjunction with the first supporting member.

19. The image forming apparatus according to claim 15, further comprising:

a container configured to contain the belt unit and the detecting member, the container capable of being withdrawn from the image forming apparatus, wherein the belt unit is rotatable in relation to the container while the detecting member remains in the withdrawn container.

20. The image forming apparatus according to claim 11, wherein the moving device moves the detecting member so that a distance between the detecting member and the belt member is greater at the first position that at the second position, in conjunction with an operation to move the belt unit from the first position to the second position.

* * * * *